US006552689B2

(12) United States Patent
Shinichi

(10) Patent No.: US 6,552,689 B2
(45) Date of Patent: Apr. 22, 2003

(54) PORTABLE COMMUNICATION TERMINAL

(75) Inventor: Haruyama Shinichi, Yokohama (JP)

(73) Assignees: Samsung Yokohama Research Institute (JP); Samsung Electronics, Co., Ltd. (KR)

( * ) Notice: Subject to any disclaimer, the term of this patent is extended or adjusted under 35 U.S.C. 154(b) by 0 days.

(21) Appl. No.: 10/010,655

(22) Filed: Nov. 8, 2001

(65) Prior Publication Data

US 2002/0084937 A1 Jul. 4, 2002

(30) Foreign Application Priority Data

Nov. 13, 2000 (JP) ..... 2000-345452

(51) Int. Cl.[7] ..... H01Q 1/24

(52) U.S. Cl. ..... 343/702; 343/792; 343/795; 343/821

(58) Field of Search ..... 343/702, 790, 343/791, 792, 795, 820, 821, 822, 830, 859; H01Q 1/24, 9/16

(56) References Cited

U.S. PATENT DOCUMENTS 4,186,403 A * 1/1980 Dorne ..... 343/801
4,504,836 A * 3/1985 Seavey ..... 343/761
4,730,195 A * 3/1988 Phillips et al. ..... 343/792
5,061,944 A * 10/1991 Powers et al. ..... 343/795
5,748,156 A * 5/1998 Weber ..... 343/762
6,177,911 B1 * 1/2002 Yuda et al. ..... 343/792

* cited by examiner

*Primary Examiner*—Tho Phan
(74) *Attorney, Agent, or Firm*—Dilworth & Barrese, LLP

(57) ABSTRACT

Disclosed is a portable communication terminal usable at multiple frequencies while being capable of achieving a reduction in specific absorption rate (SAR). The terminal includes two dipole antennas mounted on an antenna printed circuit board (PCB) mounted to a PCB of the terminal and respectively adapted to operate at usable frequencies f1 and f2. A coaxial cable is connected at its end to the dipole antennas, and a cylindrical bazooka type balun (bazooka) for multiple frequencies is fitted around the end of the coaxial cable. The bazooka includes a first dielectric cylinder, a second dielectric cylinder, and a conductor cylinder. The dielectric cylinders are coaxially fitted in the dielectric cylinder. The dielectric cylinders are used for the frequencies f1 and f2 while having electrical lengths corresponding to the frequencies f1 and f2, respectively.

10 Claims, 5 Drawing Sheets

PORTABLE COMMUNICATION TERMINAL

This application claims priority to an application entitled "Portable Communication Terminal", filed in the Japanese Patent Office on Nov. 13, 2000 and assigned Serial No. 2000-345452, the contents of which are hereby incorporated by reference.

BACKGROUND OF THE INVENTION

1. Field of the Invention

The present invention relates to a portable communication terminal usable at multiple frequencies, and in particular, to a portable communication terminal, such as a portable telephone or a personal handyphone system (PHS), which is capable of achieving a reduction in specific absorption rate (SAR).

2. Description of the Related Art

As the use of portable communication terminals such as portable telephones has increased, much attention has been paid to their effects on the human body, in particular, the head, when it is exposed to electromagnetic waves radiated from those portable communication terminals. SAR is a measure of such effects of electromagnetic waves on the human body. In a portable communication terminal, current concentrates on the antenna of the terminal. As a result, electromagnetic fields are concentrated about the head of the user to which a radiation source, for example, the feeding point of the antenna, is closely positioned. This results in an increase in SAR. Currently, a number of research efforts are being made to achieve a reduction in SAR. Also, guidelines for the protection of the human body from electromagnetic waves are being established.

Monopole antennas have been typically used in general portable communication terminals. Such monopole antennas have an antenna structure including an antenna element and an antenna earth plate which resonate at a certain frequency. Antenna current flowing through the antenna causes earth current to flow through the PCB (Printed Circuit Board) serving as the earth plate.

It may be possible to achieve a reduction in SAR by reducing the intensity of near electromagnetic fields acting around the head of the user. However, it is difficult to control earth current. For this reason, it is difficult to control near electromagnetic fields in order to reduce the intensity thereof. As a result, it is difficult to reduce SAR in monopole type antenna systems.

In this regard, it is advantageous to use a dipole antenna (balanced power feeding antenna) involving no earth current flowing through the PCB.

Typically, feeding of power to such a dipole antenna is carried out by a coaxial cable (semirigid cable). Referring to FIG. 1*a,* the basic configuration of a dipole antenna is illustrated. In such a configuration, however, where feeding of power to a dipole antenna 10 is carried out by an unbalanced circuit, that is, a coaxial cable 11, leakage current is generated at the outer conductor of the coaxial cable 11. In order to prevent such a generation of leakage current, a balance/unbalance transformer, that is, balun, (not shown) is coupled between the dipole antenna 10 and the coaxial cable 11.

For such a balun, a transformer type balun shown in FIG. 2*a* is widely used. Of course, baluns of other types may be used. For example, a bridge type or a ladder type, which uses a lumped constant, may be used. Such types are illustrated in FIGS. 2*b* and 2*c*.

However, portable communication terminals typically use a frequency band of about 1,000 MHz or more. Recently, systems using a higher frequency band have been developed. For a high frequency band, for example, microwaves of about 2,000 MHz or more adopted in wide-band code division multiple access (W-CDMA), the baluns of FIGS. 2*a* to 2*c* are impractical because an increased high frequency loss occurs.

Meanwhile, there is a balun called a "bazooka". As shown in FIG. 1*b,* the balun, which is denoted by the reference numeral 12, is arranged around the tip of the coaxial cable 11 in the form of a cylinder while having a length of $\frac{1}{4}\cdot\lambda$. This balun is electrically open at the tip of the coaxial cable 11.

Such a bazooka type balun exhibits good electrical performance even in a high frequency band. However, where this bazooka type balun is applied to general portable communication terminals using a frequency of 800 MHz, the $\frac{1}{4}\cdot\lambda$ length thereof corresponds to about 90 mm. Accordingly, the bazooka type balun is impractical.

SUMMARY OF THE INVENTION

Therefore, the present invention has been made in view of the above mentioned problems, and an object of the invention is to provide a bazooka type balun having a reduced size to be usable in a plurality of frequency bands.

In accordance with the present invention, this object is accomplished by providing a portable communication terminal comprising: an antenna printed circuit board mounted on a main printed circuit board provided with a transmitting/receiving circuit; a pair of antennas mounted on the antenna printed circuit board, the first one of the antennas being used at a first frequency with the second one of the antennas being used at a second frequency higher than the first frequency; a coaxial cable for connecting the first and second antennas to the transmitting/receiving circuit; and a cylindrical balance/unbalance transformer fitted around an antenna-side end of the coaxial cable and adapted to be usable at multiple frequencies, the balance/unbalance transformer including a first dielectric cylinder having a length corresponding to the first frequency, a second dielectric cylinder having a length corresponding to the second frequency, and a conductor cylinder, the second dielectric cylinder and the conductor cylinder being coaxially fitted in the first dielectric cylinder.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE PREFERRED EMBODIMENT

Figure 1:
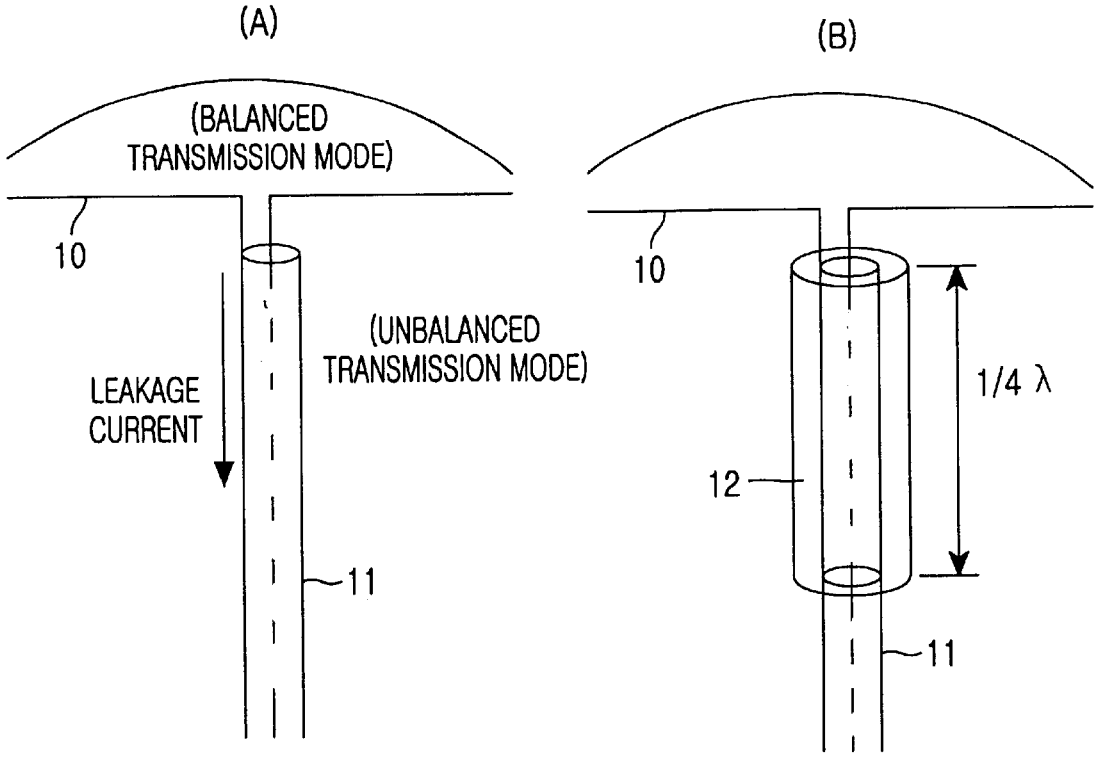
FIG.1 (PRIOR ART)
FIGS. 1*a* and 1*b* are schematic views respectively illustrating a general dipole antenna.
Figure 2:
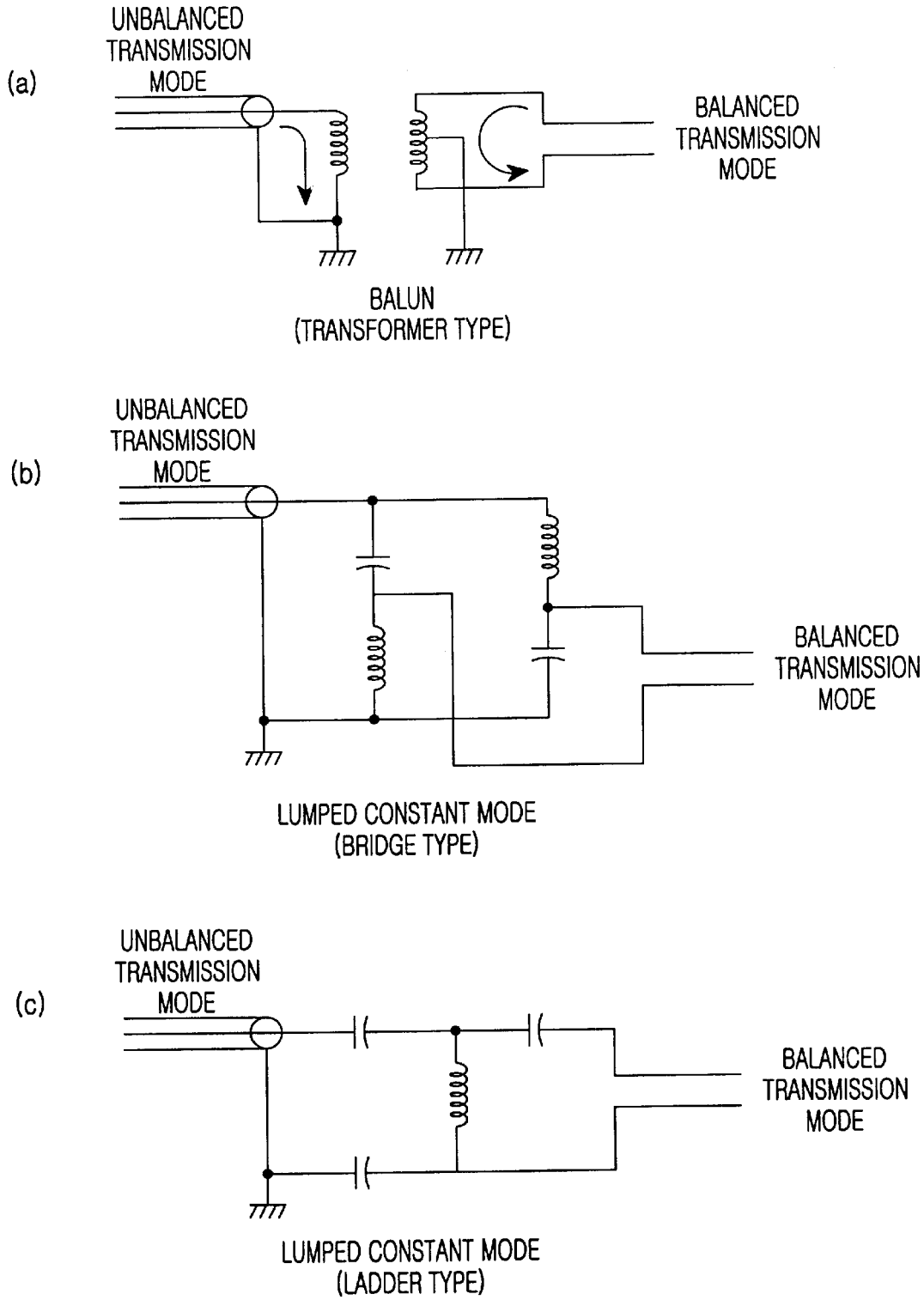
FIG.2 (PRIOR ART)
FIGS. 2*a* to 2*c* are circuit diagrams respectively illustrating a general balun.

Now, preferred embodiments of the present invention will be described in detail, with reference to the annexed drawings.

FIGS. 3*a* and 3*b* are schematic views illustrating an antenna structure in a portable communication terminal having usable frequencies f1 and f2 in accordance with an embodiment of the present invention. FIG. 3*a* is a front view, and FIG. 3*b* is a side view.

In FIGS. 3*a* and 3*b,* the reference numeral 1 denotes a PCB mounted in a terminal body, the reference numeral 2 denotes an antenna PCB arranged at an upper portion of the PCB 1, the reference numeral 3 denotes a first dipole antenna provided at the antenna PCB 2 and adapted to operate at the frequency f1, and the reference numeral 4 denotes a second dipole antenna (hereinafter, the first and second dipole antennas will simply be referred to as an "antenna") provided at the antenna PCB 2 and adapted to operate at the frequency f2. The reference numeral 5 denotes a transmitting/receiving circuit arranged at a lower portion of the PCB 1. In a general portable communication terminal, its antenna is arranged at the upper portion of the PCB, and its transmitting/receiving circuit is arranged at the lower portion of the PCB, as shown in FIGS. 3*a* and 3*b*. The reference numeral 7 denotes a coaxial cable for connecting the transmitting/receiving circuit 5 to respective feeding points of the antenna 3 and 4, and the reference numeral 8 denotes a bazooka type multi-frequency resonance balun (hereinafter, simply referred to as a "bazooka") having a double dielectric cylindrical structure fitted around an antenna-side end of the coaxial cable 7.

The coaxial cable 7 has a bent structure in order to space the bazooka 8 and antenna PCB 2 apart from the PCB 1, as shown in FIG. 3*b*. Referring to FIG. 3*b,* the antenna PCB 2 is spaced apart from the PCB 1 by a distance d. Accordingly, the bazooka 8 and antenna PCB 2 are electrically suspended from the PCB 1.

Figure 4:
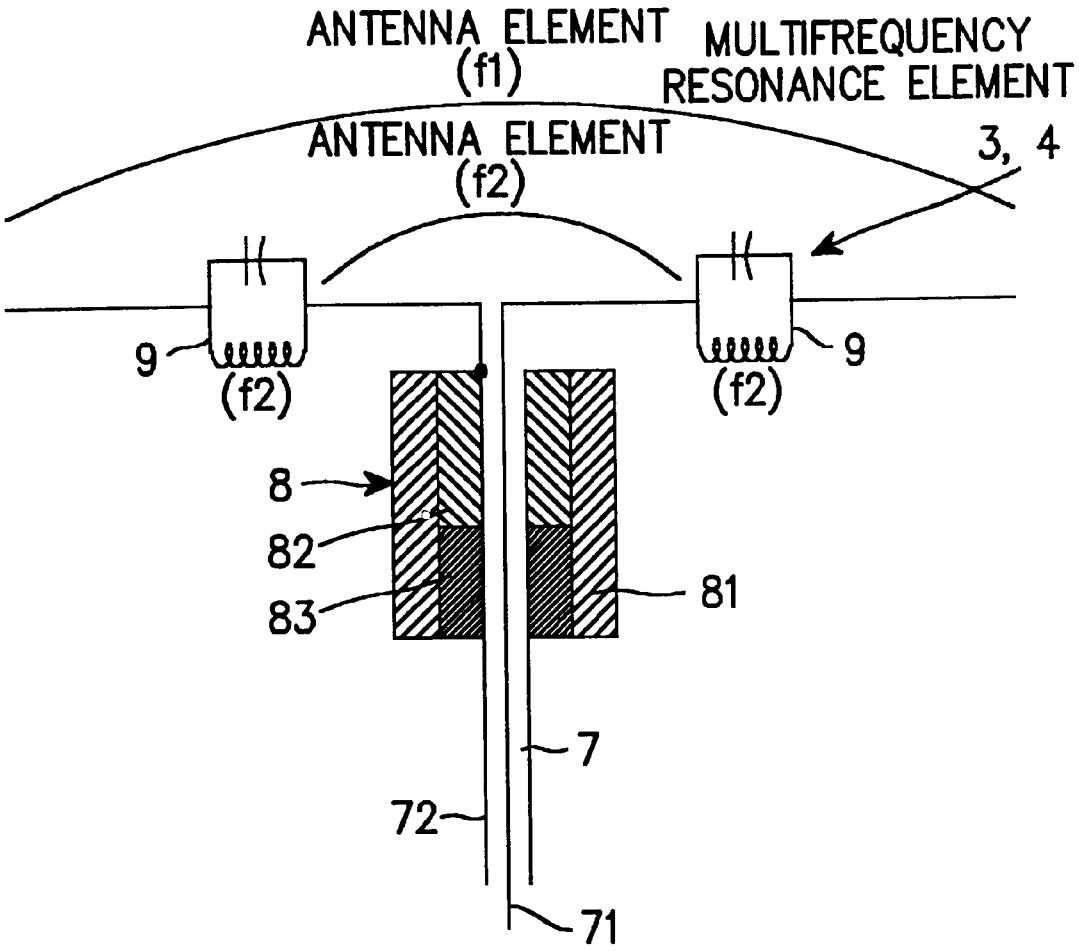
FIG. 4 is a view illustrating a bazooka type balun according to the embodiment of the present invention.
Figure 5:
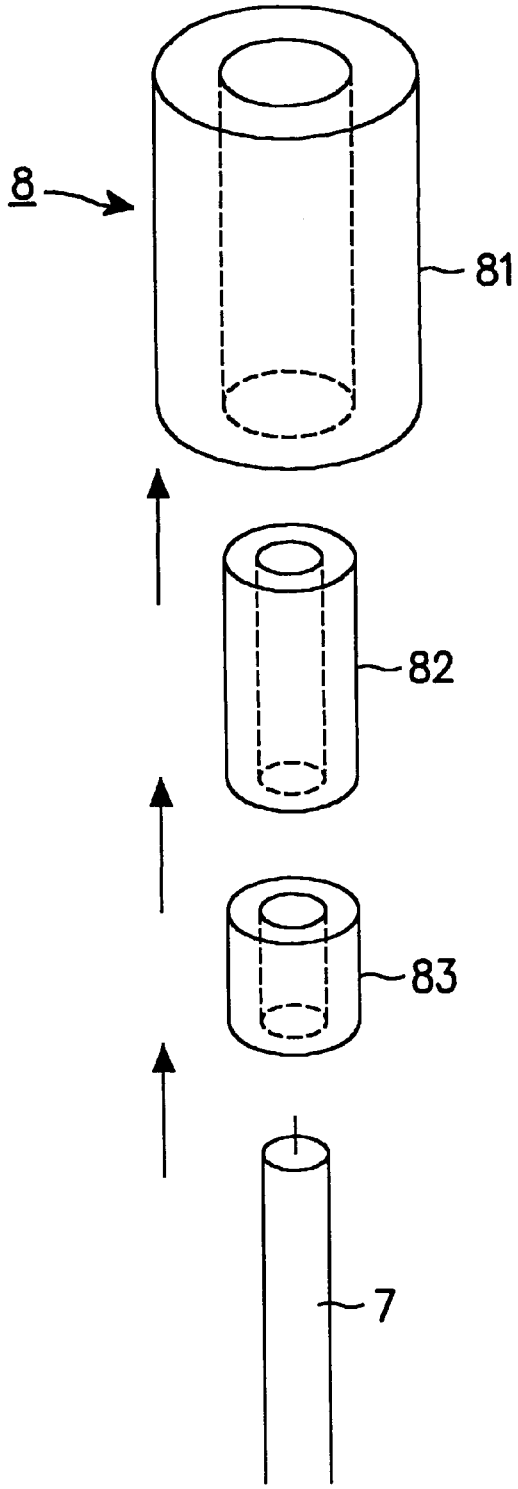
FIG. 5 is an exploded view illustrating the bazooka type balun according to the embodiment of the present invention.

FIGS. 4 and 5 illustrate the structure of the bazooka 8 having dielectric cylinders.

Referring to FIG. 4, each of the antennas 3 and 4 has an antenna structure having multi-frequency resonance elements. That is, the antennas 3 and 4 include a trap circuit 9 for trapping the frequency f2, an antenna element for the frequency f1, and an antenna element for the frequency f2.

Referring to FIG. 5, the bazooka 8 includes a first dielectric cylinder 81, a second dielectric cylinder 82, and a conductor cylinder 83. The second dielectric cylinder 82 and conductor cylinder 83 are coaxially fitted in the first dielectric cylinder 81. The conductor cylinder 83 is fitted in a lower end of the dielectric cylinder 81 positioned toward the transmitting/receiving circuit 5. The lower end of each dielectric cylinder 81 or 82 serves as a short-circuited surface, whereas the upper end of the dielectric cylinder 81 or 82 serves as an open terminal. The coaxial cable 7 is fitted in the second dielectric cylinder 82 and conductor cylinder 83 at its upper end.

Referring back to FIG. 4, the coaxial cable 7 includes a central conductor 71 and an outer conductor 72. The central conductor 71 is connected to one end of each antenna 3 or 4, whereas the outer conductor 72 is connected to the other end of the antenna 3 or 4 while being in contact with respective inner peripheral surfaces of the second dielectric cylinder 82 and conductor cylinder 83.

The first dielectric cylinder 81 may be used for the frequency band of general portable communication terminals, for example, the frequency f1, while having an electrical length of $\frac{1}{4}\cdot\lambda g1$. The second dielectric cylinder 82 may be used for the frequency band of W-CDMA, for example, the frequency f2, while having an electrical length of $\frac{1}{4}\cdot\lambda g2$.

Thus, the bazooka 8 is provided as a balun for multiple frequencies.

The $\frac{1}{4}\cdot\lambda$ length of each dielectric cylinder 81 or 82 in the bazooka 8 may be reduced to $$\frac{1}{\sqrt{\varepsilon\gamma}}$$

by virtue of the relative dielectric constant ($\epsilon\gamma$) of the dielectric cylinder. Therefore, the dielectric cylinder can have a reduced size when it is made of dielectric ceramic. For example, where the dielectric cylinder has a relative dielectric constant ($\epsilon\gamma$) of 40.840 MHz, its length may be reduced to about 14 mm, as compared to conventional cases (the length in the case of FIG. 1*b* corresponds to 90 mm).

Figure 3:
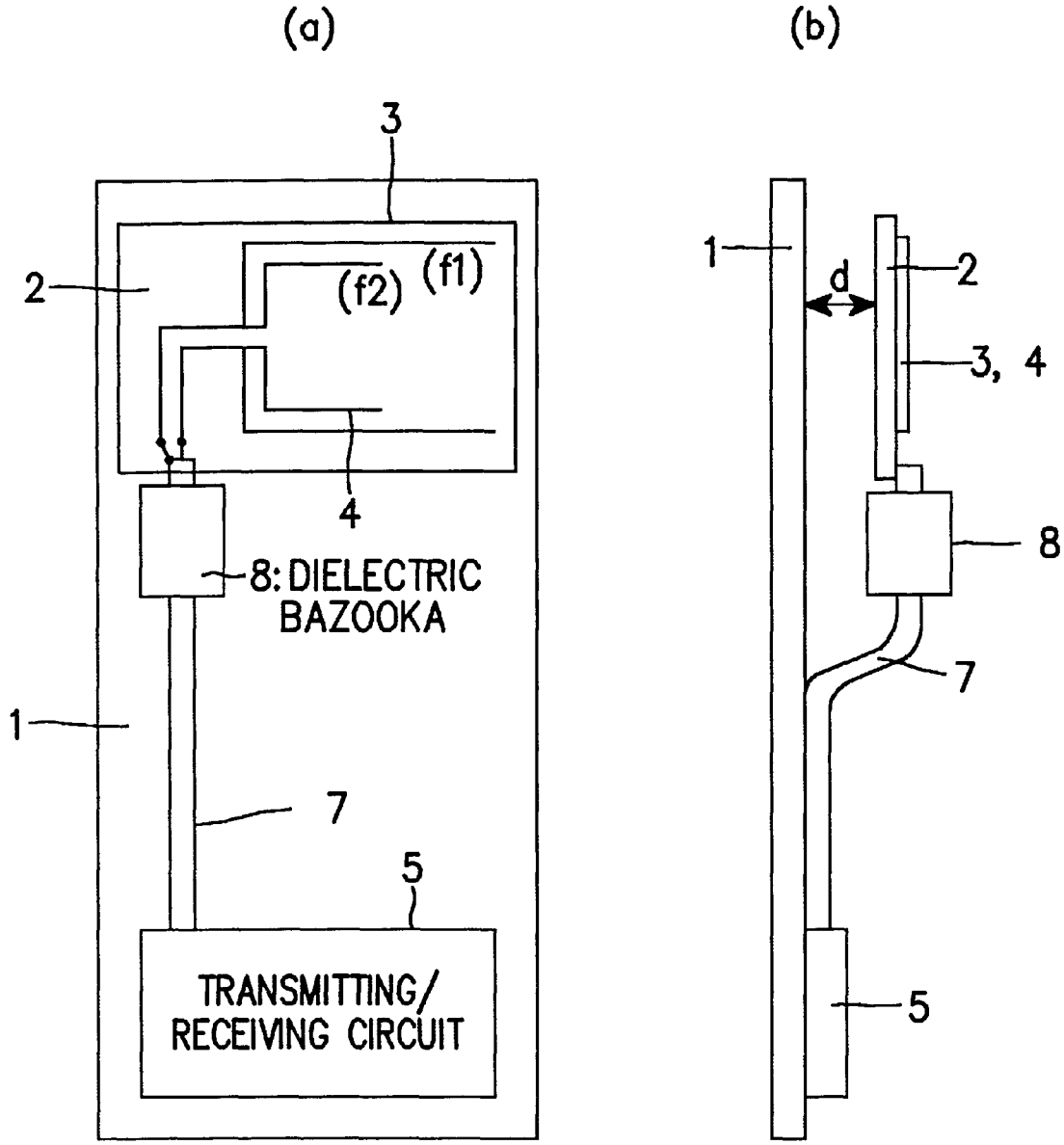
FIGS. 3*a* and 3*b* are front and side views respectively illustrating an antenna structure in a portable communication terminal in accordance with an embodiment of the present invention.

Although the present invention has been described in conjunction with the embodiment applied to a multi-frequency resonance dipole antenna including two dipole antennas as shown in FIG. 3, it is not particularly limited to such an antenna type.

As apparent from the above description, the present invention provides a portable communication terminal including two antennas respectively using different frequencies, and a balun fitted around the end of a coaxial cable for feeding power to the antennas while having two dielectric cylinders respectively corresponding to multi-frequencies, and a conductor cylinder. In accordance with this configuration, it is possible to reduce the intensity of near electromagnetic fields acting around the head of the user while preventing the flow of antenna current through the PCB of the terminal, thereby achieving a reduction in SAR. In addition, each dielectric cylinder can have a reduced size by virtue of its dielectric constant. Thus, a portable communication terminal, such as a portable telephone, usable at multiple frequencies, can be realized.

While this invention has been described in connection with what is presently considered to be the most practical and preferred embodiment, it is to be understood that the invention is not limited to the disclosed embodiment, but, on the contrary, it is intended to cover various modifications within the spirit and scope of the appended claims.

What is claimed is:

1. A portable communication terminal comprising:

an antenna printed circuit board mounted on a main printed circuit board provided with a transmitting/receiving circuit;

a pair of antennas mounted on the antenna printed circuit board, the first one of the antennas being used at a first frequency and the second one of the antennas being used at a second frequency higher than the first frequency;

a coaxial cable for connecting the first and second antennas to the transmitting/receiving circuit; and a cylindrical balance/unbalance transformer fitted around an antenna-side end of the coaxial cable and usable at multiple frequencies, the balance/unbalance transformer including a first dielectric cylinder having a length corresponding to the first frequency, a second dielectric cylinder having a length corresponding to the second frequency, and a conductor cylinder, the second dielectric cylinder and the conductor cylinder being coaxially fitted in the first dielectric cylinder, wherein the conductor cylinder is arranged beneath the second dielectric cylinder.

2. The portable communication terminal according to claim 1, wherein the first and second dielectric cylinders have a high dielectric constant.

3. The portable communication terminal according to claim 2, wherein each of the first and second antennas is a dipole antenna.

4. The portable communication terminal according to claim 3, wherein the antenna printed circuit board and the balance/unbalance transformer are electrically suspended from the main printed circuit board.

5. The portable communication terminal according to claim 1, wherein each of the first and second antennas is a dipole antenna.

6. The portable communication terminal according to claim 5, wherein the antenna printed circuit board and the balance/unbalance transformer are electrically suspended from the main printed circuit board.

7. The portable communication terminal according to claim 1, wherein the antenna printed circuit board and the balance/unbalance transformer are electrically suspended from the main printed circuit board.

8. A cylindrical balance/unbalance transformer fitted around an antenna-side end of a coaxial cable for connecting a pair of antennas to a transmitting/receiving circuit, the first one of the antennas being used at a first frequency and the second one of the antennas being used at a second frequency higher than the first frequency, comprising:

a first dielectric cylinder having a length corresponding to the first frequency;

a second dielectric cylinder having a length corresponding to the second frequency, the second dielectric cylinder being coaxially fitted in the first dielectric cylinder; and a conductor cylinder coaxially fitted in the first dielectric cylinder and arranged beneath the second dielectric cylinder.

9. The cylindrical balance/unbalance transformer according to claim 8, wherein the first and second dielectric cylinders have a high dielectric constant.

10. A portable communication terminal comprising:

an antenna printed circuit board mounted on a main printed circuit board provided with a transmitting/receiving circuit;

a pair of antennas mounted on the antenna printed circuit board, the first one of the antennas being used at a first frequency and the second one of the antennas being used at a second frequency higher than the first frequency;

a coaxial cable for connecting the first and second antennas to the transmitting/receiving circuit; and a cylindrical balance/unbalance transformer fitted around an antenna-side end of the coaxial cable and usable at multiple frequencies, the balance/unbalance transformer including a first dielectric cylinder having a length corresponding to the first frequency, a second dielectric cylinder having a length corresponding to the second frequency, and a conductor cylinder, the second dielectric cylinder and the conductor cylinder being coaxially fitted in the first dielectric cylinder, wherein the antenna printed circuit board and the balance/unbalance transformer are electrically suspended from the main printed circuit board.

* * * * *